United States Patent [19]

Magnussen, Jr.

[11] 4,099,626

[45] Jul. 11, 1978

[54] MODULAR RACK

[76] Inventor: Robert O. Magnussen, Jr., 20442 Lake Canyon Dr., Walnut, Calif. 91789

[21] Appl. No.: 768,678

[22] Filed: Feb. 15, 1977

[51] Int. Cl.[2] ..... A47F 7/00

[52] U.S. Cl. ..... 211/60 R; 211/194; 248/68 CB

[58] Field of Search ..... 211/60 R, 194, 74, 189; 248/68 CB, 49; 138/112; 46/26; 52/390, DIG. 2, 663

[56] References Cited

U.S. PATENT DOCUMENTS

| | | | |
|---|---|---|---|
| 1,821,234 | 9/1931 | Parker | 248/49 X |
| 3,081,023 | 3/1963 | Taylor | 211/74 X |
| 3,086,629 | 4/1963 | Blitzer | 52/663 X |
| 3,125,196 | 3/1964 | Fenner | 52/663 X |
| 3,429,450 | 2/1969 | Lambert | 211/74 X |
| 3,464,661 | 9/1969 | Alesi | 248/68 CB |
| 3,523,667 | 8/1970 | Guerrero | 248/49 |
| 3,526,934 | 9/1970 | Owen | 138/112 X |
| 3,590,752 | 7/1971 | DePew | 211/60 R X |

FOREIGN PATENT DOCUMENTS

| | | | |
|---|---|---|---|
| 1,467,702 | 12/1966 | France | 52/590 |
| 2,287,872 | 5/1976 | France | 211/194 |
| 2,510,828 | 9/1975 | Fed. Rep. of Germany | 248/49 |
| 1,330,786 | 9/1973 | United Kingdom | 211/74 |

*Primary Examiner*—Roy D. Frazier
*Assistant Examiner*—Rodney H. Bonck
*Attorney, Agent, or Firm*—William W. Haefliger

[57] ABSTRACT

A modular component of a rack for storing articles comprises:

a. a longitudinally elongated body having opposite sides, a longitudinally elongated boundary, longitudinally spaced segmented boundaries laterally spaced from said longitudinally elongated boundary, and longitudinally spaced laterally extending boundaries at longitudinally opposite ends of the body, b. the body having tongue and groove connections at certain of said boundaries, said connections defining guide shoulders extending widthwise between said opposite sides for guided connection with like tongue and groove connections on a like modular component, c. and said body defining through openings extending widthwise between said sides, said openings sized to receive said articles which are elongated in said widthwise direction, said through openings being longitudinally spaced between said laterally extending boundaries, and said openings located generally between said segmented boundaries.

7 Claims, 4 Drawing Figures

MODULAR RACK

BACKGROUND OF THE INVENTION

This invention relates generally to racks adapted to receive and support elongated articles; more particularly it concerns modular rack components which may be interconnected in many different ways to form circular openings to receive and support tubes in a number of different arrangements, to selectively fit and conform to available space.

Due to the varying size limitations of available storage spaces in offices, factories etc., there is a constant need for racks that may be selectively and variably conformed to such spaces. Examples of the latter are under table locations; desk top areas; and horizontal and vertical wall spaces. While modular rack systems have been proposed, none to my knowledge possesses the unusual combinations of structure, multiple functions and highly advantageous results as are now made available as by the present invention.

SUMMARY OF THE INVENTION

Basically, the invention is embodied in a modular component of a storage rack, which comprises:

a. a longitudinally elongated body having opposite sides, a longitudinally elongated boundary, longitudinally spaced, segmented boundaries laterally spaced from said longitudinally elongated boundary and longitudinally spaced, laterally extending boundaries at longitudinally opposite ends of the body.

b. the body having tongue and groove connections at certain of said boundaries, said connections defining guide shoulders extending widthwise between said opposite sides for guided connection with like tongue and groove connections on a like modular component, c. and said body defining through openings extending widthwise between said sides, said openings sized to receive said articles which are elongated in said widthwise direction, said through openings being longitudinally spaced between said laterally extending boundaries, and said openings located generally between said segmented boundaries.

As will appear, the tongue and groove connections may advantageously define T-shaped tongues projecting outwardly from selected boundaries, and T-shaped grooves sunk in or projecting inwardly from selected boundaries; the tongues and grooves may occur in alternation about and along the boundaries; each of the openings may be semi-circular so that complete circular openings are formed by joining two of the components as will appear; a large number of rack combinations may be formed by joining together pairs of the components; and component weight may be minimized by sinking cavities in the component sides, leaving flanges at the outer boundaries and also bounding the semi-circular openings, allowing for maximum interconnection surface extent, and tube supporting surface extent.

These and other objects and advantages of the invention, as well as the details of an illustrative embodiment, will be more fully understood from the following description and drawings, in which:

DRAWING DESCRIPTION

DETAILED DESCRIPTION

Figure 2:
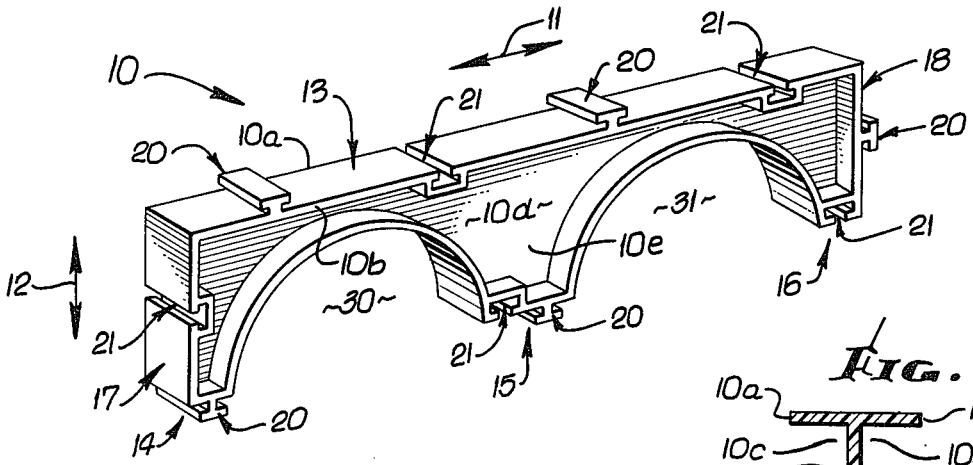
FIG. 2 is a perspective showing a modular component of the rack.
Figure 4:
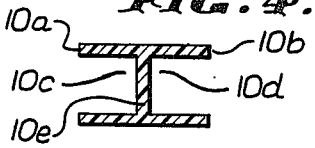
FIG. 4 is a section on lines 4—4 of FIG. 3.
Figure 3:
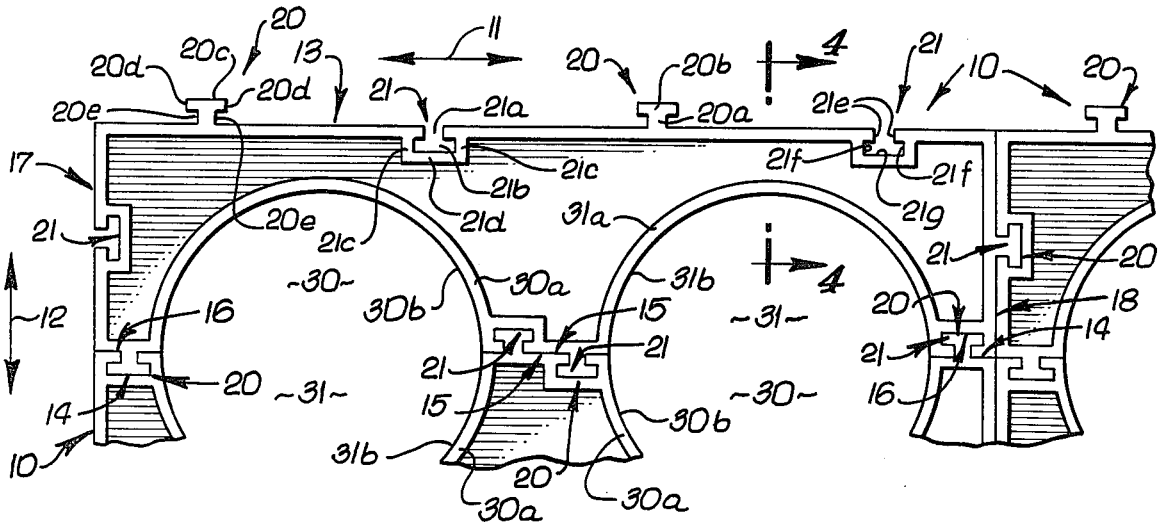
FIG. 3 is a front elevation showing interconnection of multiple modular components of FIG. 2 design.

In FIGS. 2 and 3, each modular component comprises a body 10 longitudinally elongated in directions 11. The body may be rigid and formed of molded plastic material. It has opposite planar sides **10*a* and 10*b* defined by the edges of peripheral flanges formed as a result of molding like cavities 10*c* and 10*d* into the body opposite sides, whereby the flanges bound the cavities, whereby body material and weight is substantial minimized or reduced. A central web 10*e* is formed between the cavities, as is clear from FIG. 4, web 10*e* defining a central upright plane extending in longitudinal directions 11 and lateral directions 12**.

The body has a first longitudinally elongated boundary 13, a second longitudinally oriented boundary defined by longitudinally spaced segmented boundaries 14–15 (for example) laterally spaced from boundary 13, and longitudinally spaced, laterally extending boundaries 17 and 18 at longitudinally opposite ends of the body. Such boundaries are further defined by the flanges formed adjacent the boundaries, as indicated, and separating those boundaries from the cavities **10*c* and 10*d***.

The body also has tongue and groove connections at certain of the boundaries, such connections defining guide shoulders extending widthwise between the opposite sides of the body for guided, interfitting connection with like tongue and groove connections on a like modular component. See for example the interconnections of the like modular components as appears in FIGS. 1 and 3. Such tongue and groove connections may with unusual advantage define T-shaped tongues projecting outwardly from selected boundaries, and T-shaped grooves sunk in selected boundaries, the grooves bordered by inward extents of the flanges referred to. In the drawings, the like, T-shaped tongues are generally referred to at 20, and the like T-shaped grooves at 21. They are spaced in alternation sequentially along and about the boundaries, as indicated; thus, two tongues and two grooves are alternately spaced along boundary 13; one tongue is located at boundary 18; one groove at boundary 16; one tongue and one groove at boundary 15; one tongue at boundary 14; and one groove at boundary 17. Each tongue includes a central web **20*a* and a cross-web 20*b*; and each groove includes a central slot 21*a* and a cross-slot 21*b*. Web 20*a* fits slot 21*a*, and web 20*b* fits slot 21*b*, in interfitting extents of adjacent modular components. Flange parts 21*c* and 21*d* extend adjacent slots 21*a* and 21*b*. Note that the tongues and grooves have closely interfitting, widthwise extending side walls, indicated for example at 20*c*, 20*d*, 20*e*, 21*e* 21*f*, and 21*g***.

The body also defines at least one opening, and preferably two openings, extending widthwise between the body opposite sides. Example of such openings, which are semicircular, appear at 30 and 31, such openings preferably being alike in size and shape. They are longitudinally spaced between boundaries 17 and 18, and their mouths are located generally between the segmented boundaries; thus, opening 30 is located between segmented boundaries 14 and 15; and opening 31 is located between segmented boundaries 15 and 16. Accordingly, when two, or multiple, of the components 10 are interconnected, as for example along their boundaries 14–16, 15—15 and 16–14, as seen in FIG. 3, completely circular openings 30–31 and 31–30 are formed, as shown. Such circular openings appear as bounded by the matching semi-circular flanges 30*a*–31*a* and 31*a*–30*a*, formed by the sinking of the cavities 10*d* in the opposite sides of the bodies. Therefore, substantial widthwise extending, semi-circular guide surfaces are formed at 30*b* and 31*b*, for guided reception of tubes 32 as seen in FIG. 1.

One highly advantageous body has the following dimension:

| | |
|---|---|
| overall longitudinal dimension | about 9 inches |
| overall lateral dimension | about 2¼ inches |
| overall width dimension | about 1 inches |
| circular opening diameter | about 3¼ inches |

Figure 1:
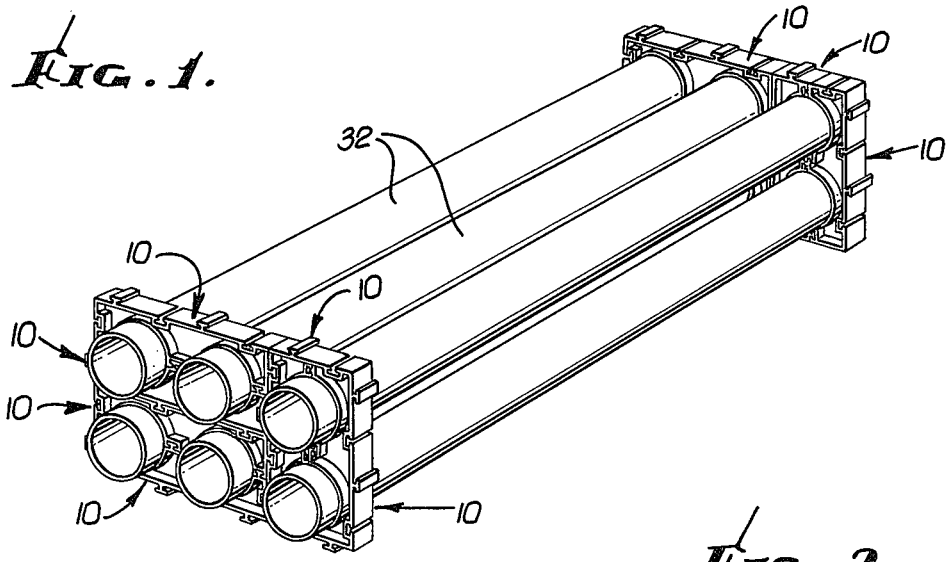
FIG. 1 is a perspective showing use of multiple racks, for storing articles.

In FIG. 1, each cluster of six bodies is arrayed with four of the bodies extending longitudinally horizontally and in stacked relation, and the fifth and sixth bodies extending longitudinally vertically, side by side, at the ends of the four horizontal bodies, thereby to form six circular openings.

Tubes 32 may be used to receive and store drafting paper, drawings, etc. Also, other elongated objects such as conduit, smaller pipes, etc. may be conveniently stored. The body material may consist of high impact polystyrene.

I claim:

1. A modular component of a rack for storing articles, comprising a. a longitudinally elongated body having opposite sides, a longitudinally elongated boundary, longitudinally spaced segmented boundaries laterally spaced from said longitudinally elongated bondary, and longitudinally spaced laterally extending boundaries at longitudinally opposite ends of the body, b. the body having tongue and groove connections at certain of said boundaries, said connections defining guide shoulders extending widthwise between said opposite sides for guided connection with like tongue and groove connections on a like modular component, c. and said body defining two through openings extending widthwise between said sides, said openings sized to receive said articles which are elongated in said widthwise direction, said through openings being longitudinally spaced between said laterally extending boundaries, and said openings located generally between said segmented boundaries.

d. said tongue and groove connections defining T-shaped tongues projecting outwardly from selected boundaries, and T-shaped grooves sunk in selected boundaries, e. said tongues and grooves occurring in alternation sequentially along and about said boundaries, f. four of said connections being spaced along said longitudinally elongated boundary, another four of said connections being spaced along said segmented boundaries with two of the other four connections located at the segmented boundary located between said openings, and wherein one of said connections is located at each of the boundaries at opposite ends of the body, the body longitudinal dimension being about four times as great as the body lateral overall dimension, g. whereby six of said bodies may be interconnected via tongues and grooves to form six circular through openings, four of the bodies extending longitudinally horizontally, and two of the bodies extending longitudinally vertically.

2. The component of claim 1 wherein each of said openings is semi-circular.

3. The combination comprising multiple of the bodies as defined in claim 2, interconnected to form circular through openings.

4. The combination of claim 3 wherein six bodies are interconnected via tongues and grooves to form six circular through openings, four of the bodies extending longitudinally horizontally, and two of the bodies extending longitudinally vertically.

5. The combination of claim 3 including tubes extending through said openings, in interfitting relation with body extents bounding said openings.

6. The component of claim 1 wherein the body has cavities sunk in its opposite sides, in inwardly spaced relation from said boundaries, whereby flanges are formed between said boundaries and cavities.

7. The component of claim 1 wherein the body longitudinal overall dimension is about 9 inches, the body lateral overall dimension is about 2¼inches, and the body width overall dimension is about 1 inch.

* * * * *